United States Patent [19]

D'Elia et al.

[11] Patent Number: 4,902,298

[45] Date of Patent: Feb. 20, 1990

[54] TANNING COMPOSITION AND ITS USE IN THE TANNING AND POST-TANNING OF ANIMAL HIDES

[75] Inventors: Mauro D'Elia, San Donato Milanese; Angelo Romano, Cesano Maderno, both of Italy

[73] Assignee: Prodeco S.p.A., Milan, Italy

[21] Appl. No.: 290,442

[22] Filed: Dec. 27, 1988

[30] Foreign Application Priority Data

Jan. 15, 1988 [IT] Italy ..... 19079 A/88

[51] Int. Cl.[4] ..... C14C 3/08

[52] U.S. Cl. ..... 8/94.33; 8/94.29

[58] Field of Search ..... 8/94.23, 94.29, 94.19 R, 8/94.27, 94.33

[56] References Cited

U.S. PATENT DOCUMENTS 2,847,396 8/1958 Sellet ..... 8/94.33

3,989,805 11/1976 Notari et al. ..... 423/462

4,443,221 4/1984 May et al. ..... 8/94.32

*Primary Examiner*—Paul Lieberman

*Assistant Examiner*—John F. McNally

*Attorney, Agent, or Firm*—Hedman, Gibson, Costigan & Hoare

[57] ABSTRACT

A tanning composition containing:

(a) aluminum chlorohydroxide (b) the product of condensation of dicyandiamide and formaldehyde;

(c) basic chrome sulphate; and (d) polyacrylic acid, polymethacrylic acid or a copolymer of acrylic acid and methacrylic acid;

makes it possible, in the tanning treatments, of stably fixing high chrome levels in the animal hides, and of exhausting, to a substantially complete extent, the chrome contained in the tanning bath.

9 Claims, No Drawings

TANNING COMPOSITION AND ITS USE IN THE TANNING AND POST-TANNING OF ANIMAL HIDES

The present invention relates to a tanning composition, and to its use in the processes for animal hides tanning and post-tanning Tanning processes have been long known and used, which are suitable for converting animal hides into leather. Such processes generally comprise an initial preparation of the hide, the conversion thereof into leather by means of tanning agents, and the finishing of the so-obtained leather. The tanning agents more commonly used for the intended purpose are tanning agents based on tannin, chrome, alum, and oil. Among these, the chromebased tanning agents are widely used, in the preparation of shoe vamps, and hide articles for clothing and furnishings. For a general description of the problems which concern the tanning, and of the tanning agents useful for the intended purpose, reference is made to Kirk-Othmer, "Encyclopaedia of Chemical Technology", 2nd Edition, Volume 12, chapter "Leather".

A technical problem which arises in the chrome tanning processes consists in the disposal of non-used chrome, which is highly polluting, and derives both from the chrome residues contained in the exhausted baths, and from chrome not stably fixed in the hides. This latter is released during the steps following the hiding step, such as pressing, washing and post-tanning.

Attempts were done for improving the chrome tanning process, both by modifying the process parameters (e.g., mechanical action, pH and temperature of the tanning bath), and partially recycling the exhausted tanning baths. Unfortunately, even with the introduction of these expedients, the polluting load in the chrome-based tanning process remains high.

In the art, the use was proposed as well of tanning baths in which chrome is combined with one or plural synthetic tannins, which makes it possible the chrome contained in the bath to be better used. However, satisfactory exhausting chrome in these tanning baths, and simultaneously achieving a good chrome level stably fixed in the hides, and good general features of the so-tanned hides, remains arduous.

The purpose of the present invention is overcoming the drawbacks which affect the technique known from the prior art, as hereinabove briefly mentioned, by means of a special tanning composition, which makes it possible chrome to be practically completely depleted during the tanning step, and tanned hides endowed with good general characteristics to be produced, which contain high levels of chrome stably fixed in the same hides.

In accordance therewith, the present invention, according to an aspect thereof, is concerned with a tanning composition containing:

(a) from 25 to 40% by weight of an aluminum chlorohydroxide, definable by means of the general formula:

$$Al_2(OH)_{1.5-3.0}Cl_{4.5-3.0}$$

(b) from 5 to 20% by weight of the product of condensation of dicyandiamide and formaldehyde, containing free methylol groups;

(c) from 35 to 55% by weight of basic chrome sulphate, expressed as an aqueous solution at 12% by weight of chrome oxide ($Cr_2O_3$); and (d) from 5 to 15% by weight of polyacrylic acid, polymethacrylic acid, or a copolymer of acrylic acid and methacrylic acid having a molecular weight comprised within the range of from 1,000 to 100,000.

Aluminum chlorohydroxide, used as the (a) component of the composition according to the present invention, can be obtained from alumina and hydrochloric acid, e.g., by means of such processes as disclosed in U.S. Pat. Nos. 3,989,805, 3,909,439 and 4,082,685. In said aluminum chlorohydroxide, the ratio of chlorine to aluminum is particularly critical, and its value should be kept within the range of values as shown in the above reported formula; this, is order to achieve good performances by the tanning composition. A further requisite is, finally, that said aluminum chlorohydroxide should be free, or substantially free, from harmful impurities, in particular sulphate ion. Aluminum chlorohydroxides available from the market, which can be used for the intended purpose are those traded under the name PRODEFLOC(R) AC 190, by Prodeco company.

The (b) component of the composition according to the present invention is constituted by the condensation products of dicyandiamide and formaldehyde, soluble, with a low condensation degree, and containing free methylol groups. The processes of condensation of dicyandiamide and formaldehyde, as such, are known from the prior art.

In the preferred form of practical embodiment, the (c) component of the composition according to the present invention is polyacrylic acid, polymethacrylic acid, or a copolymer of acrylic acid and methacrylic acid, having a molecular weight comprised within the range of from 5,000 to 50,000.

Still in the preferred form of practical embodiment, the tanning composition of the present invention contains from 32 to 34% by weight of component (a); from 11 to 13% by weight of component (b); from 44 to 46% by weight of component (c); and from 9 to 11% by weight of component (d).

According to a further aspect thereof, the present invention is concerned with the use of the above disclosed tanning composition in animal hide tanning and post-tanning processes.

Such tanning processes generally comprise a preliminary processing of hide, the conversion of hide into leather, and the finishing of the so-obtained leather. More particularly, the preliminary processing comprises the soaking of hide, the dehairing of hide by means of lime (liming), sulphides, or other dehairing agents, and the fleshing of hide. If necessary, also an operation of splitting, i.e., of splitting of the hide in the direction of its thickness, and a hide blubbering, are carried out.

Then, the operations of lime removal, maceration (the purpose of which is of eliminating albuminoid substances from chorion), and pickling are carried out. This latter treatment is advantageously carried out with an aqueous solution containing sodium chloride, sulphuric acid and formic acid, with an end pH of the bath of about 3.

The tanning operation is advantageously carried out by applying the tanning composition to the pre-trated hide, by operating with end-operation temperatures of 35°-50° C., and an end pH of about 4, inside rotary drums, also denominated "paddle tumblers". Carrying out a pre-tanning with basic chrome sulphate, with the subsequent addition of the tanning composition for the tanning step, to the same pre-tanning bath, so metered as to complete the total chrome offer, may prove advantageous. In this case too, the process is advantageously carried out in such a way as to have an end-operation temperature of 35°–50° C., with an end pH of the tanning bath of about 4. By operating with the tanning composition according to the present invention, and under the hereinabove disclosed conditions, in any case a substantial depletion of chrome from the tanning bath is accomplished.

The hides, after the tanning operations, are liberated from residual water, are shaved, neutralized, dyed, stuffed and submitted to finishing treatments, which depend on the desired end use.

The tanning composition according to the present invention is suitable for the chrome tanning of all animal hydes types, and makes it possible tanned hides containing high levels of fixed chrome (3.5–4.5%; according to I.U.C./8 method) to be manufactured, with said tanned hides having a shrink temperature (Te) of about 100° C., and having good general characteristics.

The tanning composition according to the present invention yields good results also when used as a post-tanning agent. In particular in vegetable post-tanning of tanned hides, the total exhaustion of chrome contained in the post-tanning bath is achieved.

In the following experimental examples, reported for merely exemplifying, and not limitative, purposes, the following tanning composition is used:

| | |
|---|---|
| Aluminum chlorohydroxide: $Al_2(OH)_{2.7}Cl_{3.8}$ Commercial product PRODEFLOC(R) AC 190 by Prodeco | 33% by weight |
| Product of condensation of dicyandiamide and formaldehyde containing free methylol groups | 12% by weight |
| Basic chrome sulphate, as a solution at 12% by weight of $Cr_2O_3$ | 45% by weight |
| Polymethacrylic acid, having a molecular weight of about 10,000 | 10% by weight |

This composition is a liquid thick at room temperature, of dark-green colour, having a specific gravity of about 1.30 g/ml, and a pH value of about 2.

Furthermore, in the Experimental Examples 1 and 2, for the pickling 91.5 parts by weight (as referred to 100 parts by weight of pelt) of an aqueous bath containing 11% of sodium chloride, 1% of sulphuric acid, and 0.5% of formic acid is used.

EXAMPLE 1

Calves Francia 8/12, soaked and limed, fleshed and full-thickness tanned

The hides, from which lime is removed by means of a conventional lime removing treatment, is treated overnight in the pickle. The morning after, the pH value of the bath is of 3–3.2. Two third of bath is drained, and the treatment is continued as follows:

addition of the tanning composition: 10%; addition of AMPHONUTREX(R) JD: 0.5%;
tumbling (of the drums): 90 minutes;
addition of BIOKAL(R) MA: 0.5%
tumbling: 30 minutes;
addition of the tanning composition: 10%;
tumbling: 90 minutes;
addition of water at 40° C.: 50%;
addition of sodium carbonate: 1% (dissolved in lukewarm water and slowly added within a time period of about 2.5 hours);
tumbling: 180 minutes (from the end of sodium carbonate addition).

In this example, and in the following examples, the reported percentages are referred to the beamhouse weight of hide, taken as 100%.

The end temperature of the tanning bath is of 38–40° C. The hides are left standing overnight in the tanning bath, and the pH value of the tanning bath, the morning after, is of 4.0–4.1.

The shrink temperature of hide (Te), after standing for 24 hours, is of about 100° C. Chrome concentration in the exhausted bath is of 0.4 g/l, evaluated as $Cr_2O_3$.

For comparative purposes, the instant example is repeated, with the tanning composition being replaced by basic chrome sulphate 33° SCH, at 26% of $Cr_2O_3$: 4%. A hide with a shrink temperature higher than 100° C. is obtained. Chrome concentration in the exhausted bath is of 5.5 g/l, evaluated as $Cr_2O_3$.

EXAMPLE 2

Cow flanks 32 +soaked and calcined, fleshed and split ready for tanning

After lime removal, by means of a conventional lime removal treatment, the hides are trated overnight in the pickle. The morning after, the pH value of the bath is of 3.0. Half bath is drained and the process is continued as follows:

addition of the tanning composition: 16%; addition of AMPHONUTREX(R) JD: 0.5%;
tumbing: 3 hours;
addition of sodium carbonate (dissolved in lukewarm water and slowly added within a time of about 3 hours).

The end temperature of the tanning bath is of 38° C., and the end pH value is of 4.0.

The shrink temperature of hide, after a 24-hours standing time, is of 98° C. Chrome concentration in the exhausted bath is of 0.48 g/litre, evaluated as $Cr_2O_3$.

For comparative purposes, the instant example is repeated, with the tanning composition being replaced by chrome basis sulphate 33° SCH, 26% of $Cr_2O_3$: 8%.

In this case, the end pH of the tanning bath is of 3.8. The shrink temperature of hide is higher than 100° C., and chrome concentration in the exhausted bath is of 6.2 g/l, evaluated as $Cr_2O_3$.

EXAMPLE 3

Olanda calf split-Beamhouse weight

Lime is removed from hide by means of ECO-CAL(R), and hide is subsequently treated overnight with PICATAL(R) pickle. The day after, the pH value of the bath is of 2.8. Half bath is drained, and the process is continued as follows:

addition of chrome 33° SCH, at 26% of $Cr_2O_3$: 2%; addition of the tanning composition: 18%;
addition of NUTREXOL(R) 578: 1%; addition of BIOKAL(R) MA/B: 1.6%;
tumbling for 8 hours.

The end temperature of the tanning bath is of 45° C. Hide is left standing overnight in the tanning bath, and the day after the pH value of the bath is of 4.2.

Hide shrink temperature, after a 24-hours standing time, is higher than 100° C. Chrome concentration in the exhausted bath is of 0.2 g/liter, evaluated as $Cr_2O_3$.

When the instant example is repeated using the tanning composition in an amount of 7%, chrome concentration in the exhausted bath is of 1.2 g/liter, evaluated as $Cr_2O_3$.

EXAMPLE 4

Post-tanning of Argentina wet-blue splits for velvet-leather-Shaved hair

Hide is washed with 200% of water containing 0.3% of BIOKAL(R) 100 and 0.3% of acetic acid, temperature 40° C., tumbling for 15 minutes, and is submitted to the following treatments:

addition of BIOKAL(R) 100: 0.3%; addition of acetic acid: 0.3%;
tumbling: 15 minutes;
the bath is drained:
water addition: 40% (at 40° C.); addition of tanning composition: 14%;
addition of NUTREXOL(R) 578: 1%;
tumbling: 60 minutes;
addition of sodium hyposulphite: 1%;
tumbling: 20 minutes;
water addition: 60% (at 30° C.); addition of sodium bicaronate: 1.5%;
addition of sodium formate: 1%;
tumbling: 90 minutes.

At the end of the post-tanning operations, chrome is completely depleted in the exhausted bath.

Hide is drained, is washed for 10 minutes, and the treatmens of dyeing and stuffing are then carried out according to the techniques known from the prior art.

For comparative purposes, the instant example is repeated by replacing the tanning composition with chrome basic sulphate 33° SCH, at 26% of $Cr_2O_3$: 5%.

At the end of the post-tanning operations, chrome containing the exhausted bath is of 0.6 g/liter, evaluated as $Cr_2O_3$.

NOTE

AMPHONUTREX(R) JD: A commercial product by Houghton company;
BIOKAL(R) MA: A commercial product by Biokimica company;
ECOCAL(R): A commercial product by Biokimica company;
PICATAL(R): A commercial product by BASF Company;
NUTREXOL(R) 578: A commercial product by Houghton company;
BIOKAL(R) MA/B: A commercial product by Biokimica company;
BIOKAL(R) 100: A commercial product by Biokimica company;

We claim:

1. Tanning composition containing:
(a) from 25 to 40% by weight of an aluminum chlorohydroxide, definable by means of the general formula:

$$Al_2(OH)_{1.5-3.0}Cl_{4.5-3.0}$$

(b) from 5 to 20% by weight of the product of condensation of dicyandiamide and formaldehyde, containing free methylol groups;
(c) from 35 to 55% by weight of basic chrome sulphate, expressed as an aqueous solution at 12% by weight of chrome oxide ($Cr_2O_3$); and
(d) from 5 to 15% by weight of polyacrylic acid, polymethacrylic acid or a copolymer of acrylic and methacrylic acid with a molecular weight comprised within the range of from 1,000 to 100,000.

2. Composition according to claim 1, characterized in that the (d) component has a molecular weight comprised within the range of from 5,000 to 50,000.

3. Composition according to claim 1, characterized in that it contains from 32 to 34% by weight of component (a); from 11 to 13% by weight of component (b); from 44 to 46% by weight of component (c); and from 9 to 11% by weight of component (d).

4. The method of tanning animal hides comprising the step of applying the composition according to claim 1 wherein said hides are untanned hides.

5. The method of tanning animal hides comprising the step of applying the composition according to claim 2 wherein said hides are untanned hides.

6. THe method of tanning animal hides comprising the step of applying the composition according to claim 3 wherein said hides are untanned hides.

7. The method of tanning animal hides comprising the step of applying the composition according to claim 1 wherein said hides are tanned hides.

8. The method of tanning animal hides comprising the step of applying the composition according to claim 2 wherein said hides are tanned hides.

9. The method of tanning animal hides comprising the step of applying the composition according to claim 3 wherein said hides are tanned hides.

* * * * *